US007988014B2

(12) United States Patent
Jan et al.

(10) Patent No.: US 7,988,014 B2
(45) Date of Patent: Aug. 2, 2011

(54) LID LOCK MECHANISM

(75) Inventors: Te-Sheng Jan, Taipei Hsien (TW); Yu-Tao Chen, Taipei Hsien (TW); Chun-Che Yen, Taipei Hsien (TW); Gang Cheng, Shenzhen (CN); Zheng-Qiang Song, Shenzhen (CN); Meng-Hua He, Shenzhen (CN); Jian-Jun Li, Shenzhen (CN); Bing-Jing Xu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 700 days.

(21) Appl. No.: 12/118,681

(22) Filed: May 10, 2008

(65) Prior Publication Data

US 2009/0090719 A1 Apr. 9, 2009

(30) Foreign Application Priority Data

Oct. 9, 2007 (CN) ..... 2007 1 0201954

(51) Int. Cl.
*B65D 39/00* (2006.01)
*B65D 43/04* (2006.01)
*B65D 43/26* (2006.01)

(52) U.S. Cl. ..... 220/789; 220/281; 220/787; 215/301

(58) Field of Classification Search ..... 220/789, 220/281, 787, 262, 283, 326; 215/301
See application file for complete search history.

(56) References Cited

U.S. PATENT DOCUMENTS

| | | | | |
|---|---|---|---|---|
| 3,281,936 | A * | 11/1966 | De Haan et al. | 30/41.6 |
| 3,599,821 | A * | 8/1971 | Eggert et al. | 215/301 |
| 3,843,013 | A * | 10/1974 | Brooks, Jr. | 220/326 |
| 4,328,904 | A | 5/1982 | Iverson | |
| 5,156,293 | A * | 10/1992 | Petterson et al. | 220/326 |
| 5,871,113 | A * | 2/1999 | Conway et al. | 220/210 |
| 6,244,635 | B1 * | 6/2001 | Leschinger et al. | 292/87 |
| 6,612,460 | B2 * | 9/2003 | Ribeiro | 220/787 |
| 6,669,042 | B1 * | 12/2003 | Wortman | 220/3.8 |
| 6,978,791 | B2 | 12/2005 | Lee | |
| 7,878,354 | B2 * | 2/2011 | Chae | 215/301 |
| 7,900,792 | B2 * | 3/2011 | Tremmel et al. | 220/326 |
| 2008/0142517 | A1 * | 6/2008 | Nakazato | 220/201 |

FOREIGN PATENT DOCUMENTS

| | | |
|---|---|---|
| CN | 2246984 Y | 2/1997 |
| CN | 1676435 A | 10/2005 |
| GB | 2261359 | 5/1993 |
| JP | 2001-213233 | 8/2001 |
| TW | 555097 | 9/2003 |

* cited by examiner

*Primary Examiner* — Anthony Stashick
*Assistant Examiner* — Niki M Eloshway
(74) *Attorney, Agent, or Firm* — Frank R. Niranjan

(57) ABSTRACT

An exemplary lid lock mechanism (20) includes a main body (22) and a lid (24). Two resilient hooks (222) and two resisting portions (224) are formed on an inner surface of the main body. The lid includes a lid cap (242). Two hooking portions (246) and two extending pieces (248) are formed on a surface (244) of the lid cap. The hooking portions are engaged with the resilient hooks of the main body when the lid is connected to the main body. To detach the lid from the main body, the hooks of the hooking portions are disengaged from the resilient hooks of the main body.

14 Claims, 7 Drawing Sheets

LID LOCK MECHANISM

BACKGROUND OF THE INVENTION

1. Field of the Invention

The present invention generally relates to lid lock mechanisms, and more particularly, to a lid lock mechanism for detachably connecting members.

2. Discussion of the Related Art

Various types of consumer products, such as toys, portable electronic devices, and jewelry boxes usually includes a lid and a main body. Usually, a lid lock mechanism between the main body and the lid determines that it is convenient or inconvenient to use the products.

Referring to FIG. 7, a typical lid lock mechanism 10 includes a lid 12, a main body 14, and a plurality of sliding pins (not shown). The lid 12 includes a lid cap 122 and a protrusion 124 formed on a surface of the lid cap 122. Sidewalls of the protrusion 124 define a plurality of pin grooves 126. An end of the main body 14 defines a receptacle 142 for engaging with the protrusion 124 of the lid 12. An inner sidewall for defining the receptacle 142 defines a plurality of pin grooves 144 corresponding to the pin grooves 126. The sliding pins are received in the pin grooves 144 correspondingly, and the sliding pins are movable relative to the main body 14 in the pin grooves 144.

In use, the protrusion 124 of the lid 12 is inserted into the receptacle 142 of the main body 14, with the pin grooves 126 of the lid 12 corresponding to the pin grooves 144 of the main body 14. By shaking the lid 12 and the main body 14, the sliding pins recessed in the pin grooves 144 of the main body 14 partially slide into the pin grooves 126 of the lid 12. Thereby, the lid 12 is connected to the main body 14. To detach the lid 12 from the main body 14, a force is applied to the lid lock mechanism 10 to make the protrusion 124 of the lid 12 shake slightly in the receptacle 142 of the main body 14. The sliding pins retracts into the pin grooves 144 of the main body 14 under inertia or centrifugal force. Thus the lid 12 is removable from the main body 14. In this way, the lid 12 can be detached from the main body 14.

However, when opening or closing the lid 12, two hands are required are needed to grasp the lid 12 and the main body 14. Therefore, the lid lock mechanisms with the lid 12 and the main body 14 are inconvenient to use. In addition, when the lid 12 is removed from the main body 14, the sliding pins may slide out of the pin grooves 144 of the main body 14 and are easily lost.

Therefore, a lid lock mechanism for connecting members which is convenient to be operated is desired.

SUMMARY

An exemplary lid lock mechanism includes a main body and a lid for connecting to the main body. Two resilient hooks and two resisting portions are formed on an inner surface of the main body. The lid includes a lid cap. Two hooking portions, two extending pieces and two resilient members are formed on a surface of the lid cap. Each hooking portions includes a hook formed at an end thereof. The hooks of the hooking portions are engaged with the resilient hooks of the main body when the lid is connected to the main body. To detach the lid from the main body, the hooks of the hooking portions are disengaged from the resilient hooks of the main body.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present lid lock mechanism. Moreover, in the drawings, like reference numerals designate corresponding parts throughout the several views, and all the views are schematic.

DETAILED DESCRIPTION OF THE EMBODIMENTS

Reference will now be made to the drawings to describe preferred embodiments of the present lid lock mechanism in detail.

Figure 1:
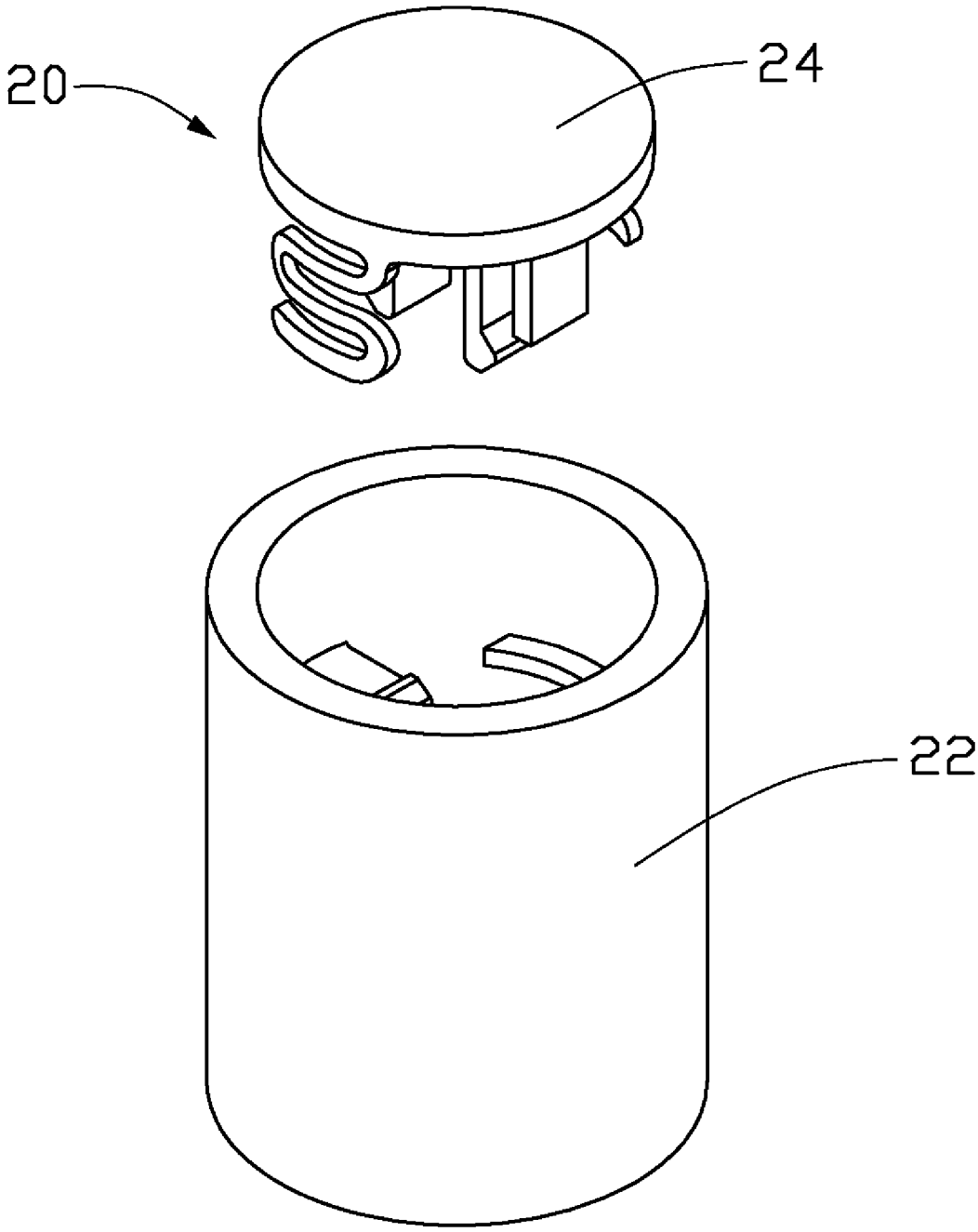
FIG. 1 is an exploded, isometric view of a lid lock mechanism for connecting a lid and a main body in accordance with a preferred embodiment of the present invention.

Referring to FIG. 1, a lid lock mechanism 20 for connecting a main body 22 and a lid 24 is shown.

Figure 2:
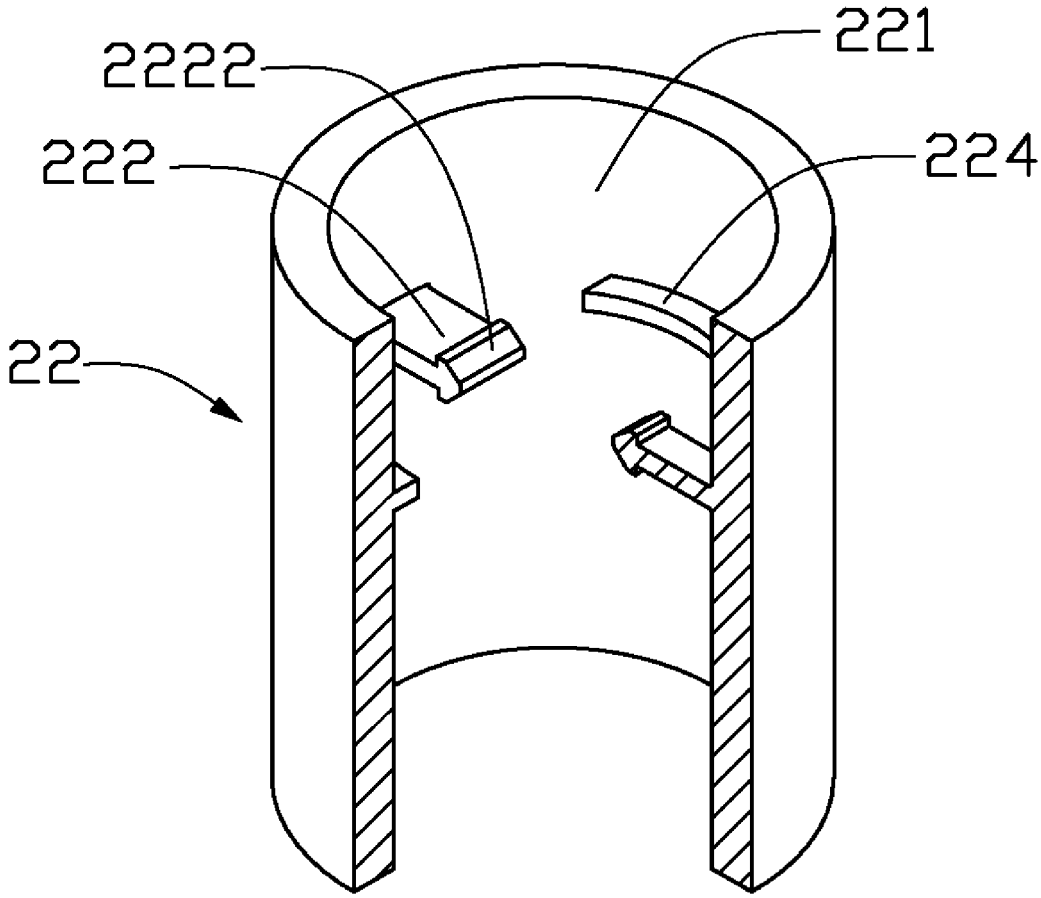
FIG. 2 is a cut-away view of the main body of FIG. 1.

Referring to FIG. 2, the main body 22 is substantially a hollow cylinder. The main body 22 includes a circular opening 221. Two resilient hooks 222 and two resisting portions 224 are perpendicularly formed on an inner surface of the main body 22. Each of the resilient hooks 222 is substantially a rectangular sheet, and an exposing end of each of the resilient hooks 222 forms a hook end 2222. The two resilient hooks 222 are aligned mirroring each other, with the hook ends 2222 of the resilient hooks 222 pointing toward each other. The resilient hooks 222 are elastic, and are bendable when an external force is applied. Alternatively, the hook ends 2222 of the resilient hooks 222 may be omitted. Each resisting portion 224 is substantially an arched strip. The resisting portions 224 are aligned mirroring each other. Alternatively, the main body 22 may include two openings. In such cases, there may be two lids 24 accordingly.

Figure 3:
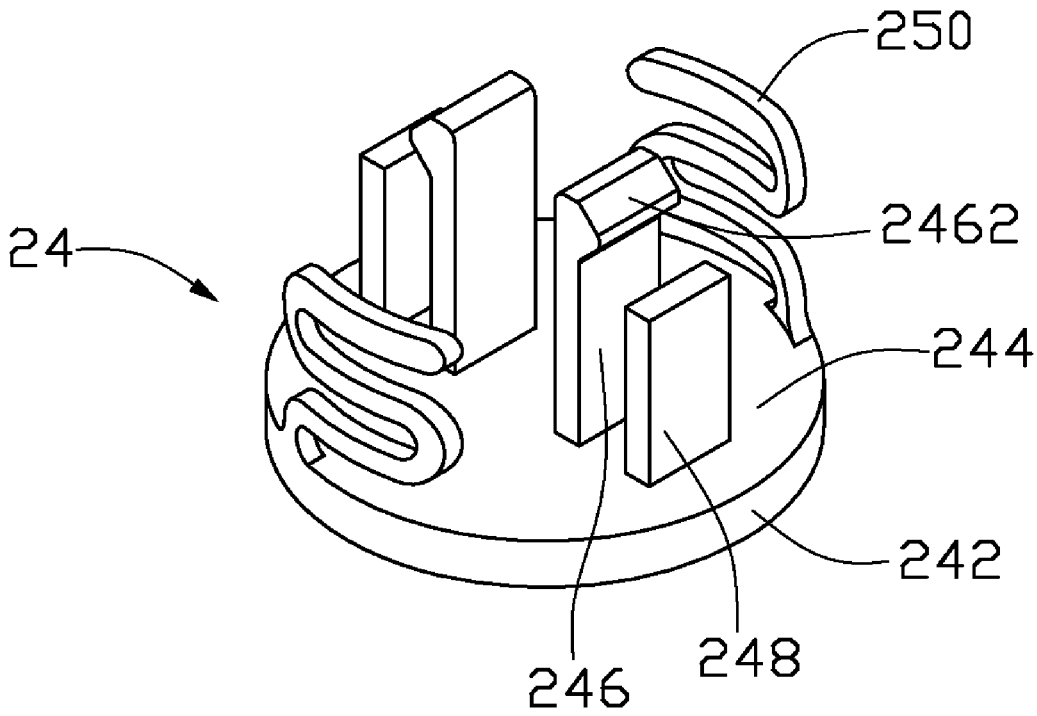
FIG. 3 is an isometric view of the lid of FIG. 1.

Referring to FIG. 3, the lid 24 includes a circular lid cap 242. The lid cap 242 fits the opening 221 of the main body 22. That is, a shape and size of the lid cap 242 corresponds to that of the opening 221 of the main body 22.

Two hooking portions 246, two extending pieces 248, and two resilient members 250 are formed on a surface 244 of the lid cap 242. The hooking portions 246 and the extending pieces 248 are parallel to each other and are aligned in a same line. A distance between each hooking portion 246 and a center of the lid cap 242 is smaller than a distance between each extending piece 248 and the center.

Each of the hooking portions 246 is substantially a rectangular sheet, and each hooking portion 246 includes a hook 2462 formed at an exposing end thereof. The two hooking portions 246 are aligned mirroring each other, with the hooks 2462 of the hooking portions 246 pointing away from each other. The hooks 2462 of the hooking portions 246 are configured for engaging with the resilient hook 222 of the main body 22.

Each of the extending pieces 248 is substantially a rectangular sheet. The extending pieces 248 are aligned mirroring each other. When the lid cap 242 is pressed, the extending pieces pushes against the resilient hooks 222 of the main body 22, the resilient hooks 222 then bend away from the opening 221 of the main body 22.

Each of the resilient members 250 is substantially an S-shaped resilient piece. When the lid 24 is in a closed state, a bottom surface of each resilient member 250 contacts the resisting portion 224 of the main body 22. When the lid 24 is in a half-open state, free ends of the resilient members 250 rest on the resisting portions 224 of the main body 22. Thus, the resilient members 250 are compressed. When the lid 24 is initially unlatched from the main body 22, the resilient members 250 return to a normal state, thereby, subsequently pushing themselves and the lid 24 away from the main body 22. In alternative embodiments, the resilient members 250 may be other elastic members, such as springs with an end fixed to the lid 24.

Figure 4:
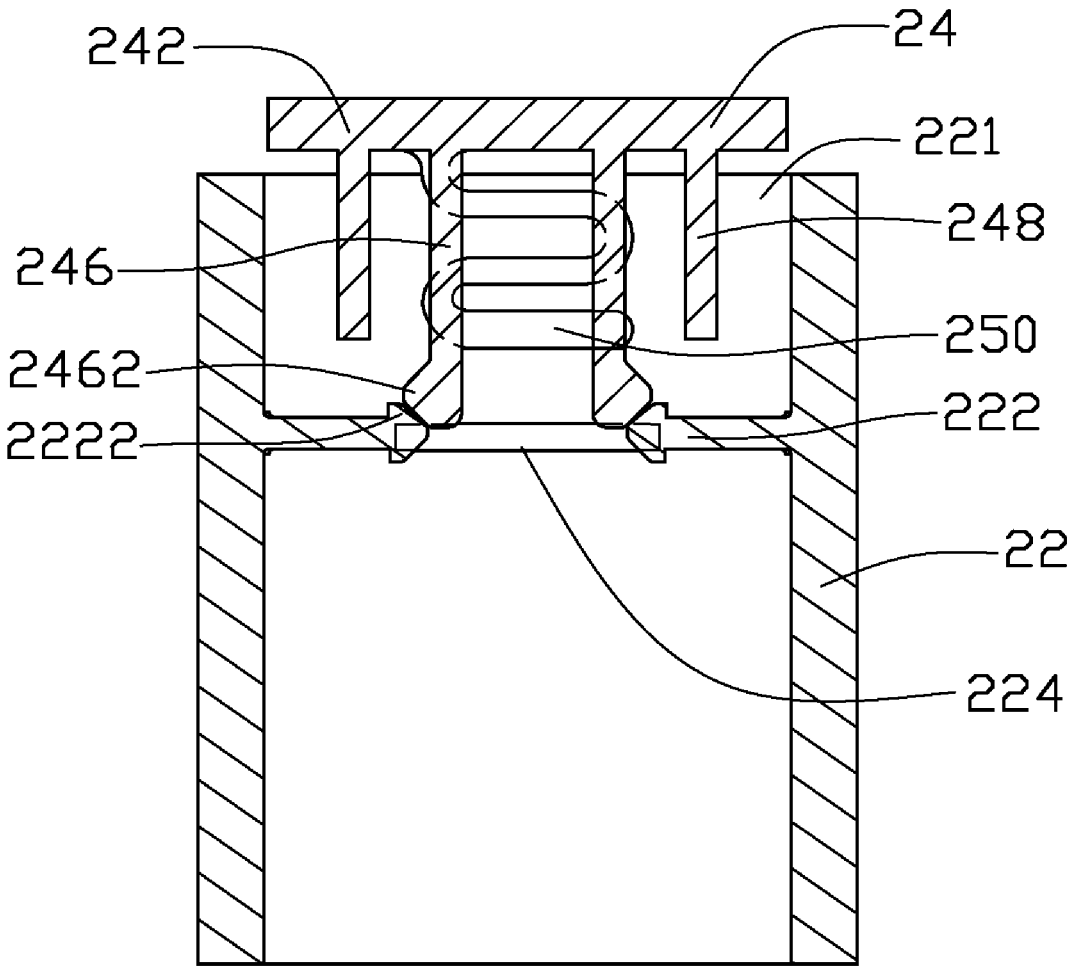
FIG. 4 is an enlarged, cross-sectional view of the lid lock mechanism of FIG. 1, showing the lid in an open state.

In use, referring to FIG. 4, when the lid 24 is in an opened state, the hooking portions 246 of the lid 24 are unlatched from the resilient hooks 222 of the main body 22. The lid 24 is removable from the main body 22. To close the lid 24, the lid 24 is positioned above the opening 221 of the main body 22, and the hooks 2462 of the lid 24 are arranged corresponding to the hook ends 2222 of the resilient hooks 222. The lid 24 is pressed downwards, the hooks 2462 of the hooking portions 246 are pressed against the hook ends 2222 of the resilient hooks 222, such that the resilient hooks 222 deform and bend away from the opening 221 of the main body 22. When the resilient hooks 222 deform such that a distance between the resilient hooks 222 is larger than a distance between the hooks 2462 of hooking portions 246, the hooks 2462 of the hooking portions 246 pass through the deformed resilient hooks 222. The hooks 2462 of the hooking portions 246 would then abut (engage) with the hook ends 2222 of the resilient hooks 222 correspondingly and the resilient hooks 222 return to a normal state.

Figure 5:
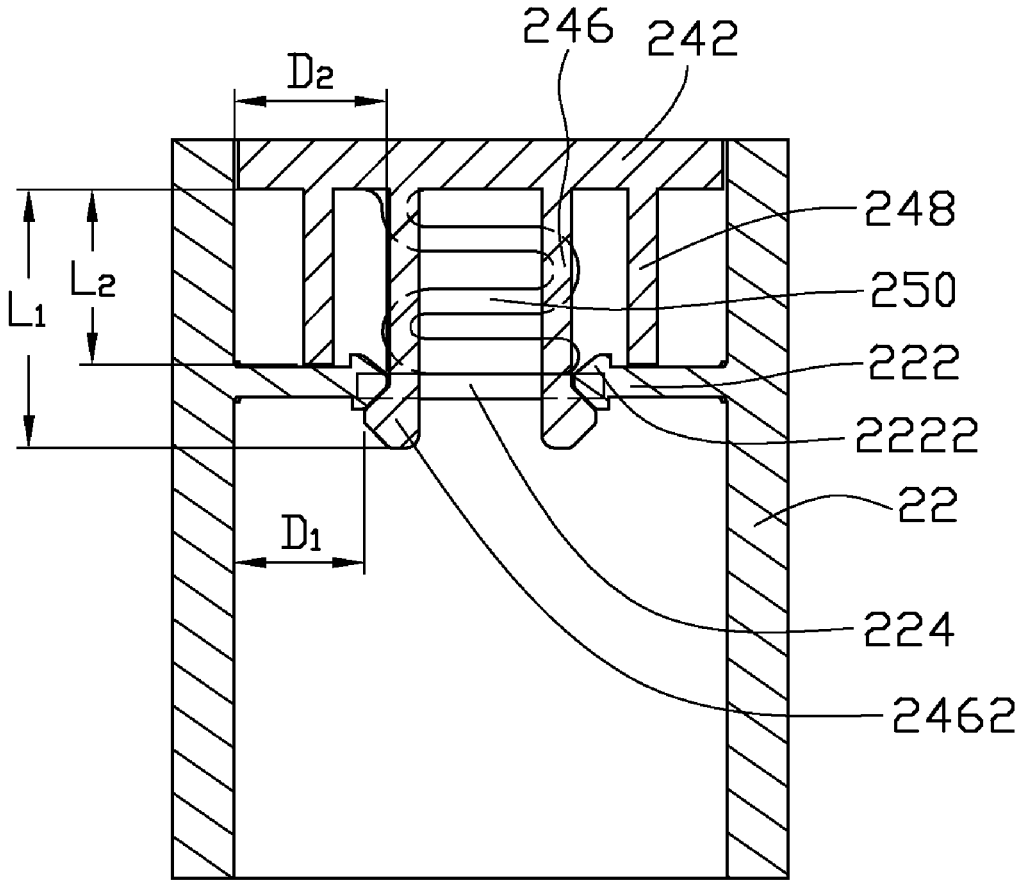
FIG. 5 is an enlarged, cross-sectional view of the lid lock mechanism of FIG. 1, showing the lid in a closed state.

Referring to FIG. 5, when the lid 24 is in the closed state, the hooks 2462 of the hooking portions 246 are engaged with the hook ends 2222 of the resilient hooks 222, and the extending pieces 248 rests on a top surface of the resilient hooks 222. Therefore, the extending pieces 248 prevent the resilient hooks 222 from bending towards the opening 221 of the main body 22. The lid 24 is thus latched to the main body 22 with bottom surfaces of the resilient members 250 contacting the resisting portion 224 of the main body 22. The lid 24 is connected to the main body 22 and is in the closed state.

Figure 6:
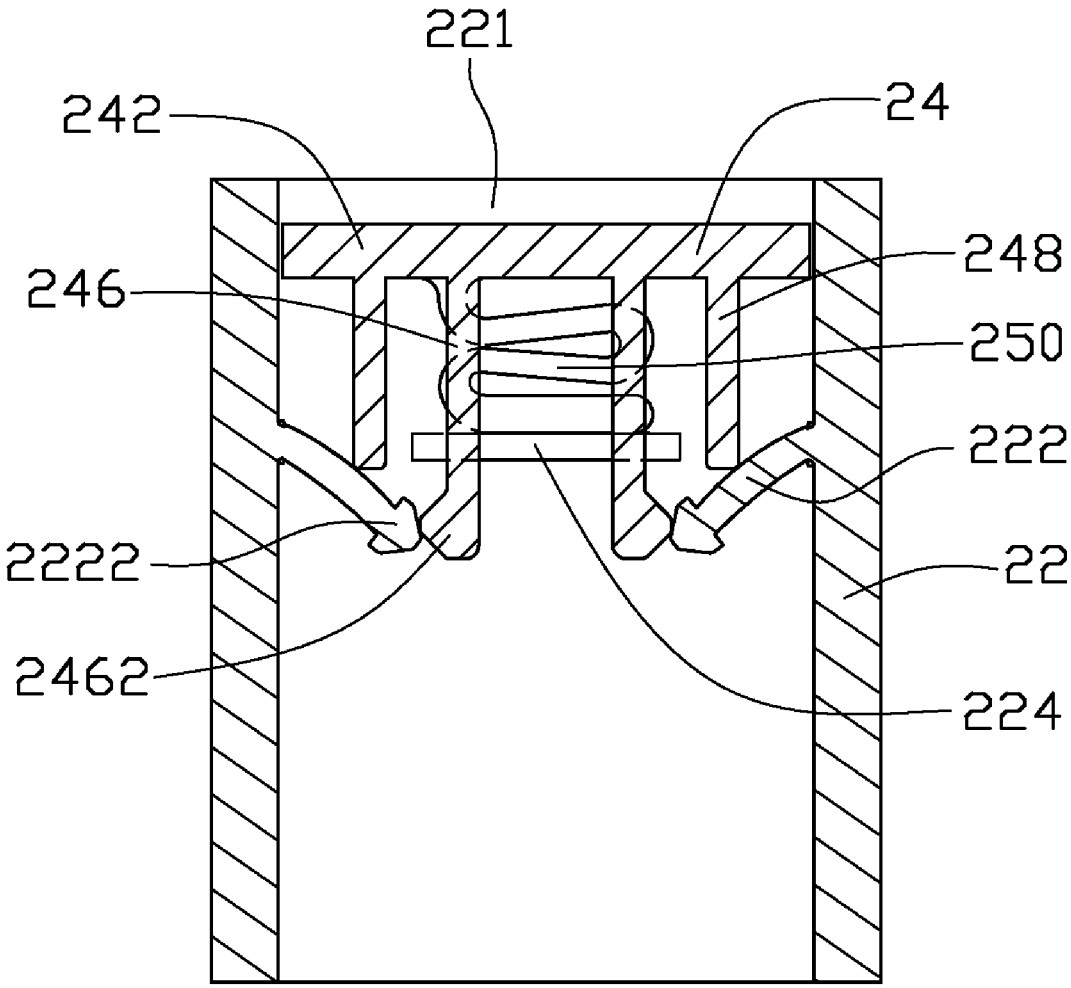
FIG. 6 is an enlarged, cross-sectional view of the lid lock mechanism of FIG. 1, showing the lid in a half-open state.
Figure 7:
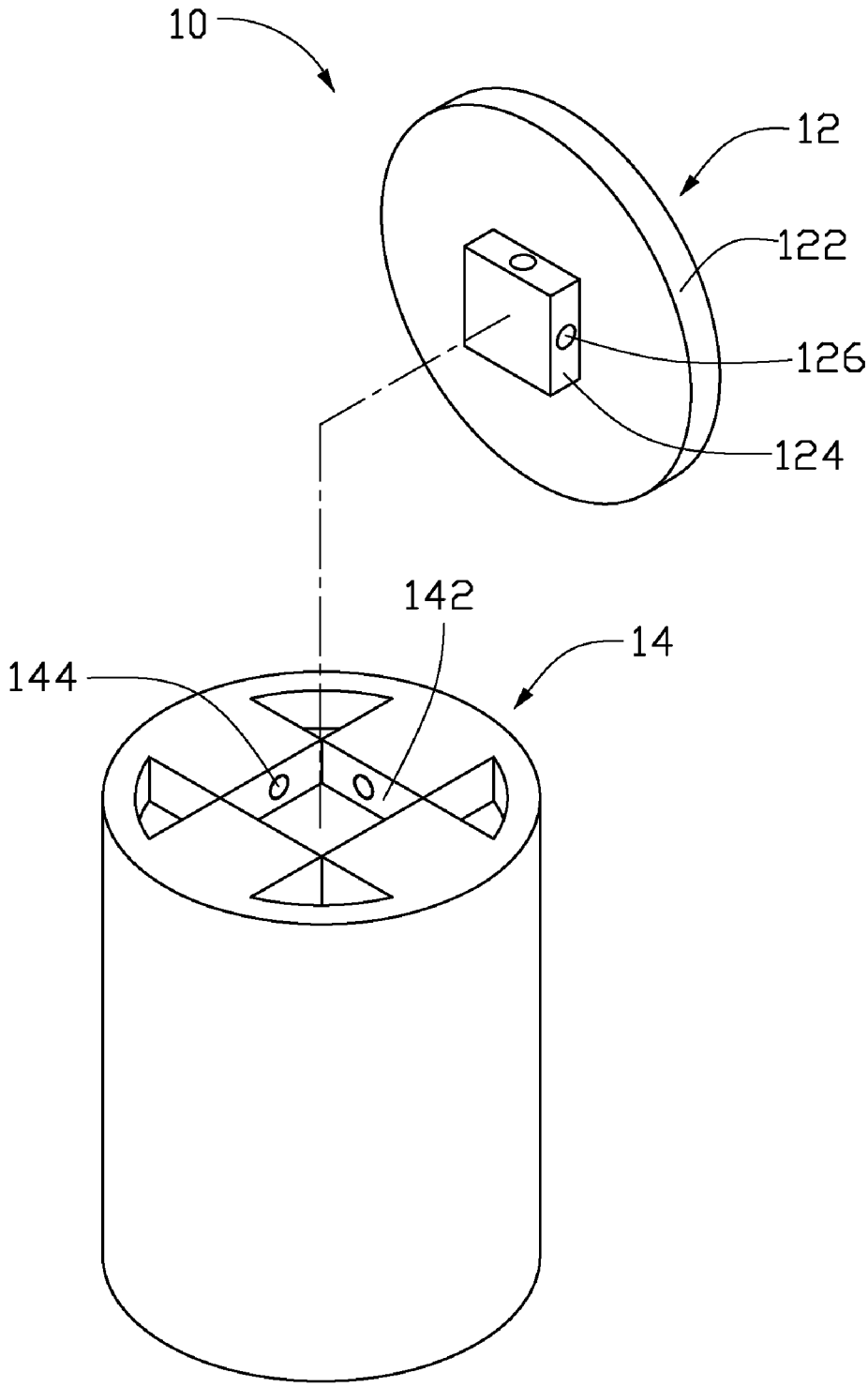
FIG. 7 (RELATED ART)
FIG. 7 is an exploded, isometric view of a typical lid lock mechanism.

Referring to FIG. 6, to detach the lid 24 from the main body 22 when the lid 24 is in the closed state, the lid 24 is pressed by an external force, and the resilient members 250 are compressed and accumulate potential energy. The extending pieces 248 of the lid 24 are pressed against the resilient hooks 222 of the main body 22, such that the resilient hooks 222 deform and bend away from the opening 221 of the main body 22. Therefore, a distance between the resilient hooks 222 increases. When the distance between the resilient hooks 222 increases to a certain extent, the hooks 2462 of the hooking portions 246 would be disengaged from the hook ends 2222 of the resilient hook 222 and pass through the resilient hooks 222 along a direction towards the opening 221 of the main body 22. The resilient members 250 decompress and drive the lid 24 away from the main body 22, thus releasing (unlatching) the lid 22 from the main body 24. The lid 24 is thus in an open state again.

Referring to FIG. 5 again, it can be understood that, in order to make the above-described operations functional, i.e., the lid 24 may be connected to or detached from the main body 22, a length of the hooking portions 246 $L_1$ (including the hooks 2462) should be larger than a length of the extending pieces 248 $L_2$ plus a thickness of the resilient hooks 222 (not including the hook ends 2222). Moreover, when the lid 24 is pressed to the main body 22, the hooks 2462 of the hooking portions 246 are engaged with the hook ends 2222 of the resilient hooks 222 after passing through the resilient hooks 222 of the main body 22. In addition, a distance between the hooks 2462 of the hooking portions 246 and an inner surface of the main body 22 $D_1$ is smaller than a distance between the end of any one of the resilient hooks 222 (including the hook ends 2222) and the inner surface of the main body 22 $D_2$.

Alternatively, in the lid lock mechanism 20, an amount of the hooking portions 246, the extending pieces 248, the resilient members 250, the resilient hooks 222, and the resisting portions 224 may be only one or more than two. The resilient members 250 may be omitted, and the resisting portions 224 may also be omitted.

With the lid lock mechanism 20, in the process of opening and closing the lid 24, a user can use one hand. Therefore, the lid lock mechanism 20 is very convenient. In the situation where repeated opening and closing of the lid 24 is needed, this convenience is much more appreciated or desirable.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A lid lock mechanism comprising:

a main body having an opening and at least one resilient hook being formed on an inner surface of the main body;

a lid for connecting to the main body, the lid having a lid cap for matching with the opening of the main body, at least one hooking portion, at least one resilient member and at least one extending piece being formed on a same surface of the lid cap, and the at least one hooking portion including a hook formed at an end thereof; and wherein when the lid is pressed to connect to the main body, the at least one hooking portion of the lid is engaged with the at least one resilient hook of the main body after passing through the at least one resilient hook along a first direction, when the lid is pressed to be detached from the main body, the at least one extending piece pushes the at least one resilient hook to bend, such that the hook of the at least one hooking portion is disengaged from the at least one resilient hook of the main body and passes through the at least one resilient hook along a second direction opposite to the first direction.

2. The lid lock mechanism as claimed in claim 1, wherein at least one resisting portion is formed on an inner surface of the main body, the at least one resisting portion is configured to resist the at least one resilient member of the lid.

3. The lid lock mechanism as claimed in claim 1, wherein the at least one resilient member is a resilient piece.

4. The lid lock mechanism as claimed in claim 1, wherein the at least one resilient member is a spring with an end fixed to the lid.

5. The lid lock mechanism as claimed in claim 1, wherein a distance between the hook of the at least one hooking portion and an inner surface of the main body is smaller than a distance between the end of the at least one resilient hook and the inner surface of the main body.

6. The lid lock mechanism as claimed in claim 5, wherein a length of the hooking portions is larger than a length of the extending pieces plus a thickness of the resilient hooks.

7. The lid lock mechanism as claimed in claim 1, wherein an exposing end of the at least resilient hook includes a hook end, the hook end is configured to be engaged with the hook of the at least one hooking portion.

8. The lid lock mechanism as claimed in claim 1, wherein the hook of the at least one hooking portion passes through the at least one resilient hook along a first direction, with the hook of the at least one hooking portion engaging with the at least one resilient hook of the main body, and the at least one resilient member is prevented by the at least one extending piece from bending along a second direction opposite to the first direction, such that the lid is latched to the main body.

9. The lid lock mechanism as claimed in claim 1, wherein a shape and size of the lid cap corresponds to that of the opening of the main body.

10. The lid lock mechanism as claimed in claim 1, wherein the at least one resilient hook is two resilient hooks, the at least one hooking portion is two hooking portions, and the at least one extending piece is two extending pieces.

11. The lid lock mechanism as claimed in claim 10, wherein the two resilient hooks, the two hooking portions, and the two extending pieces are respectively aligned mirroring each other.

12. The lid lock mechanism as claimed in claim 1, wherein the opening of the main body is circular, and the lid cap of the lid is circular correspondingly.

13. A lid lock mechanism comprising:

a first member having an opening, at least one resilient hook being formed on an inner surface of the first member, the at least one resilient hook being bendable; and a second member for connecting to the first member, at least one hooking portion, at least one resilient member and at least one extending piece being formed on a same surface of the second member, and the at least one hooking portion including a hook formed at an end thereof, the hook of at least one hooking portion configured for engaging with the at least one resilient hook of the first member when the second member is connected to the first member, the at least one extending piece configured for pushing the at least one resilient hook of the first member to bend when the second member is detached from the second member.

14. The lid lock mechanism as claimed in claim 13, wherein at least one resisting portion is formed on an inner surface of the first member, the at least one resisting portion is configured to resist the at least one resilient member of the second member.

* * * * *